United States Patent [19]

Pastore

[11] 4,193,438

[45] Mar. 18, 1980

[54] VERTICAL-BLIND-LIKE MODULAR ASSEMBLY

[76] Inventor: Ronald Pastore, Bishop Rd., Bedford, N.Y. 10506

[21] Appl. No.: 941,943

[22] Filed: Sep. 13, 1978

[51] Int. Cl.[2] ..... E06B 9/26

[52] U.S. Cl. ..... 160/166 A; 160/172

[58] Field of Search ..... 160/166–178

[56] References Cited

U.S. PATENT DOCUMENTS

| | | | |
|---|---|---|---|
| 2,529,714 | 11/1950 | Turkowski | 160/166 |
| 2,828,816 | 4/1958 | Nestor | 160/166 |
| 2,828,817 | 4/1958 | Achler et al. | 160/166 |
| 3,141,954 | 7/1964 | Simon | 160/166 |
| 3,283,805 | 11/1966 | Kirtley et al. | 160/178 R |
| 3,298,425 | 1/1967 | Cayton et al. | 160/178 R |
| 3,789,905 | 2/1974 | Saito | 160/172 |
| 3,860,056 | 1/1975 | Bruneau | 160/176 |
| 3,878,877 | 4/1975 | Bruneau et al. | 160/172 |
| 3,921,694 | 11/1975 | Galex | 160/166 |
| 4,122,884 | 10/1978 | Salzmann | 160/176 R |

*Primary Examiner*—Peter M. Caun

*Attorney, Agent, or Firm*—Hubbell, Cohen, Stiefel & Gross

[57] ABSTRACT

A vertical-blind-like modular assembly, in which each of the blinds may be individually replaced in situ without disassembling the entire assembly, and in which the plurality of blinds making up the assembly will maintain their substantially parallel alignment even during attempted pivotal movement while an obstruction prevents such pivotal movement of any one of the plurality of blinds, includes a spring biased slip clutch member which is common to all of the blinds. Each of the blinds is respectively removably mountable on a blind carrier by means of a blind holder which includes a hook-like portion insertable through an aperture in the blinds. When a fabric blind is used, the aperture may be reinforced by use of an insert having an aperture which is alignable with the aperture in the blinds. Each blind carrier includes a bevel gear arrangement which is keyed to a common shaft which is, in turn, driven by a common worm gear arrangement cooperable with the common slip clutch. The separate blind carrier members are linked together by removable chain link sections so that any desired link spacing can be employed and the carrier spacing can be altered without removing the entire assembly from its installed position.

17 Claims, 17 Drawing Figures

FIG. 7A.
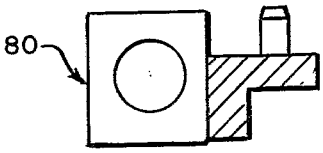
FIG. 8A.
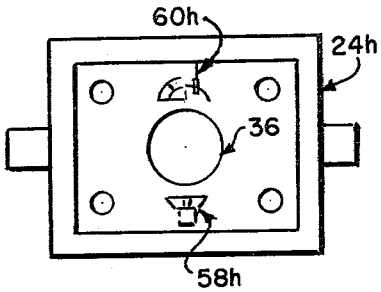
FIG. 7B.
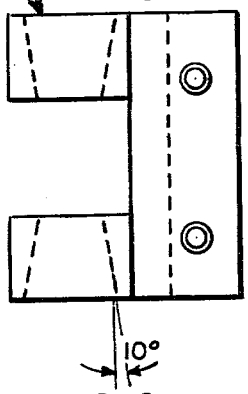
FIG. 8B.
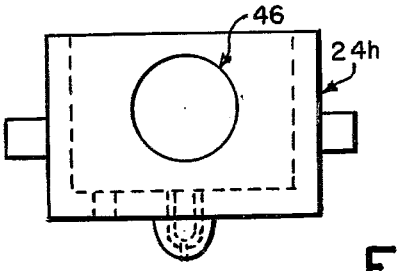
FIG. 10.
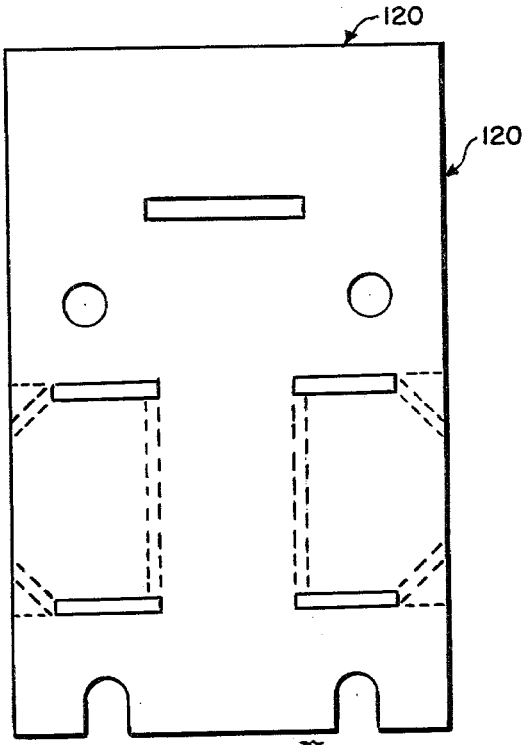
FIG. 9A.
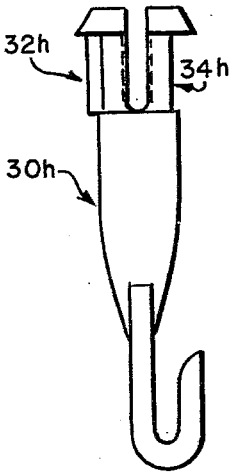
FIG. 9B.
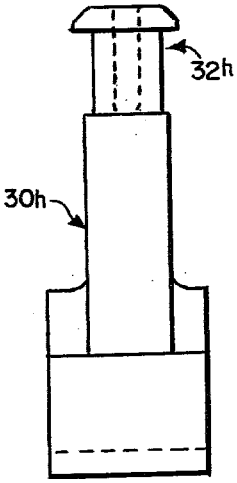
FIG. 11A.
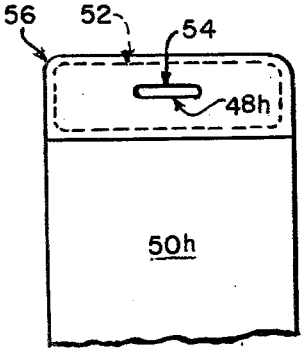
FIG. 11B.
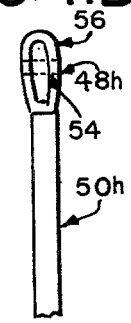
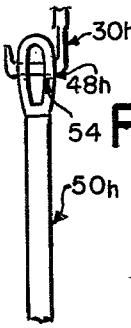
FIG. 11C.
FIG. 12.
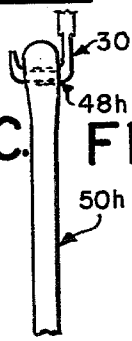

VERTICAL-BLIND-LIKE MODULAR ASSEMBLY

BACKGROUND OF THE INVENTION

1. Field of the Invention

The present invention relates to vertical-blind arrangements and more particularly to a vertical-blind-like modular assembly.

2. Statement of the Prior Art

Vertical blinds are well known and are rapidly replacing drapes and curtains as decorative and functional elements in both homes and commercial installations. Prior art vertical blinds, however, have involved complex gearing mechanisms and spacers as well as individual clutch mechanisms for each of the blind carriers which have made repair and installations of such vertical blinds both costly and time consuming. Moreover, such prior art installations known to the applicant herein are also costly and time consuming because of the required use of rivets, eyelets, etc., in assembly. In addition, one common failing of such prior art vertical blinds becomes apparent when the parallel arranged blinds are met by an obstruction, such as a book located on a window sill, when the blinds are pivoted to vary the amount of light admitted to the room. In the past, this has caused a misalignment of the blinds so that their parallel relationship is no longer maintained, causing costly repair to correct this.

During the life of an installation, it may be desired to change the width of the blinds, such as to vary the decorative effect, thereby requiring a change in the spacing between adjacent carriers, or it may be desired to change the fabric or the color of the blinds as a decorative feature. In the past, this has required disassembly of the entire prior art vertical-blind installation to accomplish such changes. Once again, this is both costly and time consuming. These disadvantages of the prior art are overcome by the present invention.

Examples of prior art vertical-blind-like assemblies are disclosed in U.S. Pat. Nos. 3,141,954; 2,828,816; 2,529,714 and 3,921,694. With respect to U.S. Pat. No. 3,141,954, this prior art arrangement discloses a heat radiating curtain, as opposed to a pure vertical-blind, in which each of the slats comprising the curtain has a separate carrier containing a bevel gear arrangement for accomplishing rotation of the slat. However, there is no common slip clutch arrangement employed and, therefore, the problem of slat or louvre misalignment when an object is struck during rotation thereof is still present. Moreover, the slat carriers disclosed in this reference are not modular and are not independently removable. Similarly, U.S. Pat. No. 2,828,816 discloses another type of vertical-blind arrangement in which each of the blinds has its own separate worm gear arrangement for rotating the blinds. Once again, however, there is no common slip clutch arrangement to overcome the above discussed problem. Other typical prior art vertical-blind arrangements are disclosed in U.S. Pat. Nos. 2,529,714 and 3,921,694; however, neither of these arrangements overcomes the problems discussed above. Thus, none of the prior art known to applicant provides a vertical-blind arrangement in which each of the blinds may be individually replaced in situ without disassembling the entire blind assembly while the plurality of blinds also maintains their substantially parallel alignment even during attempted pivotal movement in the presence of an obstruction preventing such pivotal movement of any one of the plurality of blinds.

SUMMARY OF THE INVENTION

The present invention provides a vertical-blind-like modular assembly in which each of the blinds may be individually replaced in situ without disassembling the entire assembly while the plurality of blinds comprising such an assembly is capable of maintaining its substantially parallel alignment even during attempted pivotal movement while an obstruction prevents such pivotal movement of any one of the plurality of blinds. The assembly comprises a plurality of adjacent individually removably mountable substantially parallel alignable blind members. Means are provided for moving the blinds towards each other and away from each other, such as via a pulley arrangement, in order to vary the effective area covered by the plurality of adjacent blinds. The assembly further includes a plurality of longitudinally movable removably mountable blind carrier members with a channel being provided for removably retaining each of the blind carrier members. Each of these blind carrier members comprises a pivotally mountable movable holder vertically extending therefrom with respect to the direction of longitudinal movement of the blind carrier members in a common alignable aperture longitudinally extending through each of the carrier members. Each of these blind holders includes a hook-like portion with each of the blinds including an aperture therein adjacent one end thereof for enabling insertion of the hook-like portion therethrough for removably retaining the blind member thereon while enabling both pivotal and longitudinal movement thereof.

A plurality of removably mountable link members, such as chain links, interconnects the plurality of carrier members for enabling linked movement thereof. A common shaft member extends through the aligned longitudinal apertures in the plurality of carrier members with the linked carrier members being longitudinally slidably moveable along the common shaft as a result of the aforementioned pulley arrangement. The shaft includes a common longitudinally extending keyway with each of the carrier members including a bevel gear arrangement herein which is mountable in the keyway for simultaneous rotation therewith. The bevel gear arrangement is operatively connected to the blind holder for simultaneously rotating the blind holder for accomplishing pivotal movement of the blinds.

A removably mountable common control housing is also provided in which a common worm gear arrangement is disposed at one end of the aforementioned common shaft, with a common spring-biased slip clutch member being disposed in the control housing and being cooperable with the worm gear. The common spring-biased slip clutch member is normally spring-biased into engagement with the worm gear for simultaneous rotation therewith and is automatically disengageable when the slip clutch member is rotated while rotation of the common shaft keyway is prevented, such as by prevention of rotation of any of the bevel gear arrangements of the carrier members. This slip clutch member is automatically engageable into such engagement when the slip clutch member is rotated and such prevention of rotation is not present. Thus, the bevel gear arrangement in each of the carrier members comprises a 1:1 gear ratio at each of the carrier members with the worm gear arrangement providing a common gear reduction for the carrier members.

BRIEF DESCRIPTION OF DRAWINGS

FIGS. 7A and 7B are diagrammatic illustrations of a carrier attachment for converting any of the typical blind carriers into a lead carrier;

FIGS. 8A and 8B are a bottom plan and side elevation, respectively, of the typical carrier of FIG. 6;

FIGS. 9A and 9B are a side and rear elevation, respectively, of the removable hook-like portion of the typical carrier of FIG. 6;

FIG. 10 is a bottom plan view of the control housing cover for use with the typical control housing of FIGS. 1 and 2, prior to removal of the pop-out inserts thereof;

FIGS. 11A–11C are a fragmentary view of a typical fabric blind having a removable insert therein; and FIG. 12 is a fragmentary side view similar to FIG. 11C of a typical blind of the type not requiring a removable reinforcing insert.

DETAILED DESCRIPTION OF PREFERRED EMBODIMENT

Figures 1, 2, 3, 4, 5, 6:
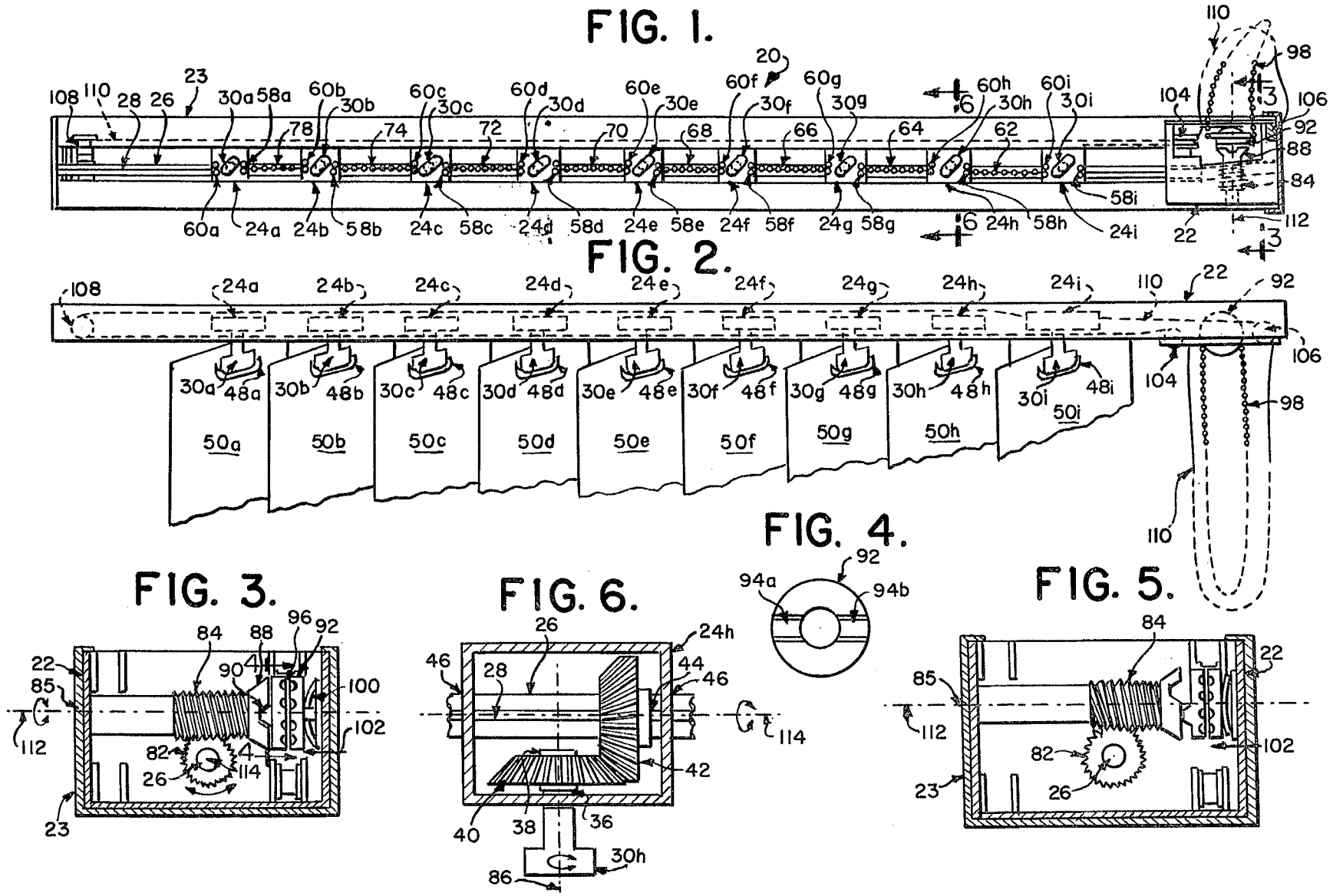
FIGS. 1 and 2 are a diagrammatic illustration, partially fragmentary, of the vertical-blind-like modular assembly of the present invention, with FIG. 1 being a bottom plan view of the arrangement of FIG. 2 with the blinds removed for purposes of clarity.
FIG. 3 is a sectional view of the common control housing of the arrangement of FIGS. 1 and 2 taken along line 3—3 in FIG. 1, illustrating the common spring-biased slip clutch member in engagement with the common worm gear arrangement.
FIG. 4 is a sectional view taken along line 4—4 of FIG. 3 of the pulley wheel portion of the common slip clutch arrangement.
FIG. 5 is a sectional view similar to FIG. 3 but with the common spring-biased slip clutch out of engagement with the common worm gear arrangement.
FIG. 6 is a sectional view taken along line 6—6 of FIG. 1 of a typical blind carrier member, illustrating the bevel gear arrangement thereof.

Referring now to the drawings in detail and initially to FIGS. 1 and 2 thereof, a typical preferred vertical-blind-like modular assembly in accordance with the present invention, generally represented by the reference numeral 20, is shown. Modular assembly 20 preferably includes a common control housing 22, to be described in greater detail hereinafter with reference to FIGS. 3, 4, 5 and 10, a common track 23, such as one formed of aluminum, and a plurality of blind carrier members 24, with nine such blind carrier members **24*a–i*, inclusive, being shown by way of example in FIGS. 1 and 2. Preferably all of the blind carrier members 24*a–24i* are identical with the exception that blind carrier member 24*i* is employed as a lead carrier and therefore further includes the arrangement illustrated in FIGS. 7A and 7B mounted thereon. A typical such blind carrier member 24*h* will be described in greater detail hereinafter with reference to FIGS. 6, 8A, 8B, 9A and 9B. Each of these blind carrier members 24*a–24i* is preferably slidably mounted on a common shaft 26, having a common keyway 28 therein with the carrier members 24*a–24i* being longitudinally slidable therealong and with the shaft 26 being rotatable within the carrier members 24*a–24i*, as will be described in greater detail hereinafter, such as with reference to FIGS. 3–6**.

As shown and preferred in FIGS. 1, 2, 6, 11C and 12, by way of example, each of the blind carrier members **24*a–24i* includes a removably mountable blind holder 30*a–30i*, respectively, which comprises a hook, such as illustrated in greater detail in FIGS. 9A and 9B with reference to typical hook 30*h*. As shown and preferred in FIGS. 9A and 9B, the hook, 30*h* by way of example, includes a pair of spaced apart resilient fingers 32*h* and 34*h*, by way of example, which are insertable through a bottom aperture 36 in the associated carrier member 24*h* to removably retain the hook in the carrier member 24*h* mountable on a shaft 38 which extends through a substantially horizontal bevel gear 40 which is in meshing relationship with a substantially vertical bevel gear 42 (FIG. 6) which is, in turn, keyed to the common shaft 26 by means of a protrusion 44 thereon residing in the keyway 28. As was previously mentioned, this common shaft 28 extends through a common aperture 46 in the sidewalls of the carrier member 24*h***.

The aforementioned hook **30*a–30i*, respectively, preferably extends through an aperture 48*a–48i*, respectively, located at the upper end of each of the removably mountable vertical-blinds 50*a–50i*, respectively. If each of the vertical-blinds 50*a–50i*, inclusive, has sufficient strength, such as being composed of aluminum or polyvinylchloride by way of example, then no additional reinforcement of this aperture 48*a–48i*, respectively, is required. However, if a softer material, such as a soft fabric, which may readily tear during a period of prolonged use is employed for the vertical-blinds 50*a–50i*, then preferably a reinforcing insert 52, such as illustrated in FIGS. 11A–11C, is utilized. The reinforcing insert 52 preferably contains an aperture 54 therein which is alignable with aperture 30*a–30i*, in the respective vertical-blinds. In such an instance, each of the vertical-blinds is formed with a pocket 56 at the top through which the removable reinforcing insert 52 is insertable. The hook 30*h* is therefore insertable through the aperture 48*h* and the aligned aperture 54 so as to support the respective vertical-blind 50*h* thereon as illustrated in FIG. 11C. If no fabric insert is required, then the hook 30*h* is inserted solely through the aperture 48*h* to support the vertical-blind 50*h* thereon such as illustrated in FIG. 12. Due to the modular construction of the vertical-blind-like assembly 20, each of the blinds 50*a–50i* may be individually replaced in situ without disassembling the entire assembly 20**.

As further shown and preferred in FIGS. 8A and 8B, as well as in FIG. 1, each of the typical carrier members **24*a–24i* also preferably includes a pair of spaced apart resilient fingers 58*h* and 60*h*, by way of example for carrier 24*h*, located at opposite longitudinal ends of the bottom of each of the carrier members 24*a–24i* for removably receiving a link member therein in order to link adjacent carrier members 24 together for linked longitudinal movement along the common shaft 26. Preferably, a chain link member, such as the type commonly employed for key chains, is snap-fit into the pair of resilient fingers, 58*h* by way of example, and the next adjacent pair of resilient fingers for the next adjacent carrier, such as 60*i* for example, to link the adjacent carriers 24*h* and 24*i* by way of example, together. Similarly, in the same manner, carrier 24*h* is linked to adjacent carrier 24*g*, carrier 24*g* is linked to adjacent carrier 24*f*, carrier 24*f* is linked to adjacent carrier 24*e*, carrier 24*e* is linked to adjacent carrier 24*d*, carrier 24*d* is linked to adjacent carrier 24*c*, carrier 24*c* is linked to adjacent carrier 24*b*, and carrier 24*b*** is linked to adjacent carrier 24*a* so as to link carriers 24*a*–24*i*, inclusive, together for linked longitudinal movement with lead carrier 24*i* by means of chain link segments 62, 64, 66, 68, 70, 72, 74, and 78, respectively, all of which are preferably of a predetermined length. If desired, these chain link segments may be snap-fittably removed without disassembling the unit and other chain link segments, of different predetermined lengths, may be substituted therefor so as to change the spacing between the adjacent carriers 24*a*–24*i*, inclusive. With respect to lead carrier 24*i*, as was previously mentioned, the arrangement of FIGS. 7A and 7B is readily mountable thereon with this attachment 80 readily converting a typical carrier 24 into a lead carrier.

Now referring to FIGS. 3 and 5, the control housing 22 shall be described. As is shown and preferred in FIGS. 1, 3 and 5, the control housing 22 is preferably located at one terminus of the common shaft 26 which includes a conventional gear 82 mounted thereon for simultaneous rotation therewith, such as by pinning the gear conventionally to the shaft 26. The control housing 22 is preferably tightly retained in place by surrounding track 23 to prevent distortion of the control housing 22 when the slip clutch assembly 88 through 100 disengages. Disposed directly above gear 22 in meshing relationship therewith is a worm gear 84 preferably pinned to a shaft 85 which causes gear 82 to rotate as worm gear 84 rotates, thereby turning shaft 26, thus simultaneously rotating keyway 28 thereon, causing bevel gear 42 to rotate which, in turn, causes bevel gear 40 to rotate. This causes the blind carrier hook 30*a*–30*i*, respectively, to rotate about axis 86 to change the angle of the blinds 50*a*–50*i* with respect to the plane of the window (not shown) so as to pivot the blinds 50*a*–50*i* and change the amount of light admitted to the room. As shown and preferred in FIGS. 3 and 5, the worm gear 84 preferably includes a head portion 88 having a tapered slot 90 therein and a pair of opposed edges of the head 88. A pulley type wheel 92, which preferably forms part of a common slip clutch assembly 88 through 100, inclusive, is preferably removably engageable with the worm gear head 88 by means of a pair of complementary protrusions 94*a* and 94*b* (FIG. 4) which are removably engageable in the pair of slots 90 of the head 82. The pulley type wheel 92 also preferably includes a plurality of circular apertures 96 circumferentially spaced about the wheel for receiving a conventional pull chain 98 therein such as the balls thereof in order to enable pulley wheel 92 to be rotated as the chain 98 is pulled. The balance of the common slip clutch assembly 88 through 100, inclusive, preferably comprises a conventional bent spring washer 100 which spring-biases pulley wheel 92 in the direction of arrow 102 so as to resiliently force protrusions 94*a* and 94*b* into engagement in the complementary apertures 90 of the head 88. This thereby enables the worm gear 84 to rotate simultaneously along with the rotation of pulley wheel 92 by the chain 98 being pulled.

As further shown and preferred in FIGS. 1, 3 and 5, the control housing 22 also peferably includes a pair of conventional pulley wheels 104 and 106 which, together with another conventional pulley wheel 108 located adjacent the other terminus of the shaft 26, enables longitudinal movement of the linked carrier members 24*a*–24*i*, inclusive, to draw the vertical-blinds 50*a*–50*i*, inclusive, open or closed in conventional fashion by means of a venetian blind type of cord 110 which is conventionally connected to the lead carrier 24*i* (FIG. 2). Thus, by conventionally pulling on cord 110, lead carrier 24*i* is drawn towards or away from the control housing 22, thereby causing similar movement of the other linked carriers 24*a*–24*h*, inclusive.

With respect to the operation of the presently preferred slip clutch assembly 88-90-92-94*a*-94*b*-96-98-100, as pull chain 98 is pulled upon, this causes pulley wheel 92 to rotate about axis 112 (FIGS. 1 and 3). Since bent spring washer 100 biases wheel 92 into engagement with head 88, causing protrusions 94*a* and 94*b* to rest in complementary slots 90 in head 88, this causes worm gear 84 to simultaneously rotate about axis 112. This causes rotation of gear 82 about axis 114 which thus causes rotation of common shaft 26 about this axis. Since the bevel gears 42 situated inside each of the carriers 24*a*–24*i* are keyed to shaft 26 via keyway 28, this, in turn, causes gears 42 to rotate about axis 114. Similarly, since gears 42 of each of the carriers 24*a*–24*i* is in meshing relationship with bevel gears 40 of each of the carriers 24*a*–24*i*, this causes each of these bevel gears 40 to simultaneously rotate about axis 86 which thereby rotates hook portions 30*a*–30*i*, respectively, about this axis thereby rotating the blinds 50*a*–50*i*, respectively, mounted thereon about this axis to pivot the blinds 50*a*–50*i* to an open or closed position. However, if any of the blinds 50*a*–50*i* should strike an obstruction during its gear driven rotation about axis 86 of the type which would prevent further gear driven rotation of the particular blind 50*h*, for example, this would prevent the associated bevel gear 40 from further rotation. Due to its meshing relationship with bevel gear 42, this would simultaneously also prevent further rotation of bevel gear 42 which, since it is keyed to shaft 26, would prevent further rotation of shaft 26. Since shaft 26 is, in turn, pinned to gear 82, this would prevent further rotation of gear 82. Since gear 82 is, in turn, in meshing relationship with worm gear 84, this would also prevent further rotation of worm gear 84. Thus, as the user continues to pull on chain 98, causing rotation of pulley wheel 92, since the worm gear 84 and hence its head 88 are locked against further rotation, this causes protrusions 94*a* and 94*b* on pulley wheel 92 to be displaced or rise up out of the complementary tapered slots 90 in head 88 to the positions illustrated by FIG. 5, by way of example, thereby disengaging the gear drive and preventing any further gear driven rotation of the blinds 50*a*–50*i*. As also shown and preferred in FIG. 5, this displacement causes bent washer spring 100 to be compressed.

When the obstruction is removed and the pull chain 98 is thereafter pulled, pulley wheel 92 will continue to rotate until the protrusions 94*a* and 94*b* are opposite the complementary tapered slots 96 into which they will then be forced by the resilient pressure of the previously compressed bent washer spring 100 being applied in the direction of arrow 102, whereupon the pulley wheel will be re-engaged with the worm gear head 88 so as to again cause gear driven rotation of shaft 26 and the resultant gear driven rotation of the blinds 50*a*–50*i*. Thus, the prevention of rotation of any one of the blinds 50*a*–50*i* due to the presence of an obstruction will prevent further rotation of the blinds while this obstruction is present and will, thereby, enable all of the blinds 50*a*–50*i* to maintain their substantially parallel alignment even if further rotational movement about axis 86 for each of the blinds 50*a*–50*i* is still attempted.

The aforementioned control housing gearing arrangement 82–84 provides a common gear reduction for the carrier members 24a–24i which each preferably have a bevel gearing arrangement having a 1:1 gear ratio at each of the carrier members 24a–24i. Each of the various elements of the assembly 20, including the elements of the control housing 22, may be preferably put together without any riveting or other type of fasteners being employed. In addition, as illustrated in FIG. 10 as well as in FIGS. 3 and 5, the control housing 22 may preferably include a duplicate set of mountings on both the left and right sides thereof so as to enable the common housing 22 structure to be used for either a left-hand or a right-hand blind assembly merely by relocating the appropriate pulley wheels 104, 106, 108, 92 and worm gear 84, to the left or right hand side of the control housing 22. In order to provide flexibility for this, the control housing cover 120 may be provided with punch out inserts which are identical on both the right and left sides so as to enable a flexibility of choice. As was also previously mentioned, because of the provision of carrier attachment 80, any of the carriers may be made a lead carrier, that is a carrier to which the traverse cord 110 is attached to enable the blinds to be drawn open or closed.

It should be noted that as used throughout the specification and claims herein, the expression rotational or pivotal movement of the blinds is meant to include rotation about a vertical axis, such as axis 86 for the respective blind.

Many other variations of the scope of the present invention may be accomplished, such as by providing a common control housing capable of enabling a plurality of control functions such as single-draw action or double-draw action for said modular blind assembly or left-right top or bottom draw for said modular blind assembly.

What is claimed is:

1. A vertical-blind-like modular assembly comprising a plurality of adjacent individually removably mountable substantially parallel alignable blind members; first means for moving said blinds towards each other and away from each other in order to vary the effective area covered by said plurality of adjacent blinds; a plurality of longitudinally movable removably mountable blind carrier members, a channel means for removably retaining each of said blind carrier members; each of said blind carrier members comprising a pivotally mountable removable holder vertically extending therefrom with respect to the direction of longitudinal movement of said blind carrier members and a common alignable aperture longitudinally extending through each of said carrier members; each of said blind holders including a hook-like portion; each of said blind members including an aperture therein adjacent one end thereof for enabling insertion of said hook-like portion therethrough for removably retaining said blind member thereon while enabling both pivotal and longitudinal movement thereof; a plurality of removably mountable link members interconnecting said plurality of carrier members for enabling linked movement thereof; a common shaft member extending through said aligned longitudinal aperture in each of said plurality of carrier members; said linked carrier members being longitudinally slidably movable along said common shaft by said first means; said shaft including a common longitudinally extending keyway; each of said carrier members including a first bevel gear means mountable in said keyway for simultaneous rotation therewith and a second bevel gear means disposed in meshing relationship with said first bevel gear means and substantially normal thereto for driving rotation thereby as said common keyway is rotated with said common shaft; said second bevel gear means being operatively connected to said blind holder for simultaneously rotating said blind holder with said second bevel gear means for pivoting said blind removably retained thereon as said second bevel gear means rotates; a removably mountable common control housing; a common gear means disposed at one end of said common shaft in said common control housing; a common spring-biased slip clutch member disposed in said control housing; a worm gear means disposed in said control housing in meshing relationship with said common gear means for driving said common gear means as said worm gear means is rotated; and a cord-like member removably mountable on said slip clutch member for rotating said slip clutch member by movement thereof, said cord-like member and slip clutch member comprising a pulley, said spring-biased slip clutch member being removably engageable with said worm gear means and normally spring-biased into engagement therewith, said slip clutch member being automatically disengageable when said slip clutch member is rotated while rotation of said common shaft keyway is prevented by prevention of rotation of any of said second bevel gear means and automatically engageable into said engagement when said slip clutch member is rotated and said prevention of rotation is not present, whereby each of said blinds may be individually replaced in situ without disassembling said entire assembly and said plurality of blinds will maintain their substantially parallel alignment even during attempted pivotal movement while an obstruction prevents such pivotal movement of any one of said plurality of blinds.

2. A vertical-blind-like modular assembly in accordance with claim 1 wherein each of said carrier members includes at least a pair of resilient fingers and said link members comprise chain link segments removably snap-fittably insertable between said pair of resilient fingers on said carrier member for enabling said interconnecting of said carrier members through said chain link segments for enabling said linked movement thereof, each of said chain link segments being individually removably insertable.

3. A vertical-blind-like modular assembly in accordance with claim 2 wherein each of said carrier members is adaptable to include a carrier attachment means for making any of said carriers a lead carrier cooperable with said first moving means of enabling said longitudinal movement of said linked carrier members for moving said blinds toward and away from each other.

4. A vertical-blind-like modular assembly in accordance with claim 1 wherein each of said carrier members is adaptable to include a carrier attachment means for making any of said carriers a lead carrier cooperable with said first moving means for enabling said longitudinal movement of said linked carrier members for moving said blinds toward and away from each other.

5. A vertical-blind-like modular assembly in accordance with claim 1 wherein said first and second bevel gear means comprise plastic bevel gears.

6. A vertical-blind-like modular assembly in accordance with claim 1 wherein said spring-biased slip clutch member comprises a plastic slip clutch.

7. A vertical-blind-like modular assembly in accordance with claim 6 wherein said spring-biased slip clutch member further comprises a bent washer spring member for spring biasing said slip clutch member.

8. A vertical-blind-like modular assembly in accordance with claim 1 wherein said spring-biased slip clutch member further comprises a bent washer spring member for spring biasing said slip clutch member.

9. A vertical-blind-like modular assembly in accordance with claim 1 wherein said cord-like member is a chain-like member.

10. A vertical-blind-like modular assembly in accordance with claim 3 wherein said first moving means and said lead carrier comprise a pulley arrangement for effectuating said longitudinal movement.

11. A vertical-blind-like modular assembly in accordance wtih claim 1 wherein said bevel gearing means at each of said carrier members comprises a 1:1 gear ratio at each of said carrier members.

12. A vertical-blind-like modular assembly in accordance with claim 11 wherein said common gear means and said worm gear means provide a common gear reduction for said carrier members.

13. A vertical-blind-like modular assembly in accordance with claim 1 wherein said common shaft comprises an aluminum shaft.

14. A vertical-blind-like modular assembly in accordance with claim 1 wherein said assembly is removably retainable in assembled relation by snap-fittably interconnecting said linked carrier members and said control housing in said assembly and the various elements comprising said linked carrier members and control housing.

15. A vertical-blind-like modular assembly in accordance with claim 1 wherein said control housing comprises means adaptable for left hand or right hand control of said modular assembly.

16. A vertical-blind-like modular assembly in accordance with claim 15 wherein said adaptable means comprises means adaptable for a plurality of control functions of said modular assembly.

17. A vertical-blind-like modular assembly in accordance with claim 1 wherein each of said blind members includes a reinforcement insert disposed at said one end, said insert containing an aperture therein alignable with said blind member aperture, said hook-like portion extending through said aligned apertures.

* * * * *